US006345405B1

(12) United States Patent
Brackin

(10) Patent No.: US 6,345,405 B1
(45) Date of Patent: Feb. 12, 2002

(54) TWO-IN-ONE TOOTHBRUSH

(76) Inventor: Rickie Brackin, 12927 Corcoran St., San Fernando, CA (US) 91340

( * ) Notice: Subject to any disclaimer, the term of this patent is extended or adjusted under 35 U.S.C. 154(b) by 0 days.

(21) Appl. No.: 09/546,105

(22) Filed: Apr. 10, 2000

(51) Int. Cl.[7] ..... A46B 7/00; A46B 9/04

(52) U.S. Cl. ..... 15/106; 15/167.1; 15/169; 15/184; 15/203; D4/105

(58) Field of Search ..... 15/106, 167.1, 15/167.2, 169, 172, 184, 201, 203; D4/105, 106

(56) References Cited

U.S. PATENT DOCUMENTS

| | | | | |
|---|---|---|---|---|
| 1,189,698 A | * | 7/1916 | Keating | 15/184 |
| 2,486,203 A | * | 10/1949 | Pieper | 15/203 |
| 2,511,235 A | | 6/1950 | Arwood | 15/106 X |
| 2,528,992 A | | 11/1950 | Barr | 15/167.2 |
| 2,629,122 A | | 2/1953 | Uyl | 15/106 |
| 2,701,380 A | | 2/1955 | Ripper | 15/167.2 |
| 4,328,604 A | | 5/1982 | Adams | 15/106 X |
| 4,517,701 A | * | 5/1985 | Stanford, Jr. | 15/106 |
| 5,331,704 A | | 7/1994 | Rosen et al. | 15/106 |
| 5,373,602 A | | 12/1994 | Bang | 15/167.1 |
| 5,383,244 A | | 1/1995 | Ahrens et al. | 15/106 |
| 5,465,449 A | | 11/1995 | Lewkowicz | 15/106 |
| 5,522,109 A | | 6/1996 | Chan | 15/106 |
| 5,544,383 A | | 8/1996 | Gamble | 15/106 |
| 5,758,380 A | | 6/1998 | Vrignaud | 15/106 |

FOREIGN PATENT DOCUMENTS

| | | | |
|---|---|---|---|
| EP | 285121 | * 10/1988 | 15/167.1 |
| GB | 253951 | * 11/1926 | 15/167.1 |
| IT | 647429 | * 10/1962 | 15/169 |

* cited by examiner

*Primary Examiner*—Mark Spisich
(74) *Attorney, Agent, or Firm*—Fulwider Patton Lee & Utecht, LLP

(57) ABSTRACT

The two-in-one toothbrush provides for dual sets of brushing bristles facing in opposing directions to allow the toothbrush to clean both the upper and lower teeth simultaneously. Another form of the toothbrush design allows for the movement of at least one set of brushing bristles between extended and retracted positions, for use and hygienic storage of the brushing bristles. In another form, the toothbrush design allows for the independent movement of dual sets of brushing bristles between extended and retracted positions, for use and hygienic storage of the brushing bristles.

15 Claims, 2 Drawing Sheets

TWO-IN-ONE TOOTHBRUSH

BACKGROUND OF THE INVENTION

1. Field of the Invention

This invention relates generally to toothbrushes, and more particularly concerns a toothbrush that provides multiple brushing heads.

2. Description of Related Art

While dental enamel is among the hardest substances in the body, decay in the enamel outer layer of the teeth, also referred to as dental caries, typically occurs because dental enamel can be dissolved by acid formed by bacteria commonly found in the mouth that can metabolize food, particularly sugars and starches, remaining in the mouth after meals. Since food and bacteria can be dislodged from the mouth by a toothbrush, a program of regular brushing after meals can help to reduce tooth decay. While conventional toothbrushes have been devised with various shapes and configurations of single or multiple brushes, and have even been motorized to facilitate brushing, people are typically impatient about tooth brushing, and may be unwilling to devote the time necessary for a thorough brushing of the teeth. It would therefore be desirable to provide a toothbrush with multiple sets of bristles that would allow a user to clean both the upper and lower teeth at the same time, making the process quicker and more effective.

In addition, while boxes and tubular containers have been used for storage of toothbrushes, such as in luggage while travelling, for example, such containers can break open, and leaving the toothbrush uncovered can risk exposure of the brush to contamination. It would also thus be desirable to provide a toothbrush with a mechanism for clean, hygienic storage of the brushing bristles of the toothbrush. The present invention meets these and other needs.

SUMMARY OF THE INVENTION

Briefly, and in general terms, in one presently preferred embodiment, the present invention provides for a dual brushing head design allowing the toothbrush to clean both the upper and lower teeth simultaneously. In another presently preferred embodiment, the present invention provides for one or more sets of brushing bristles that can be separately and independently extended for use, or retracted for clean, hygienic storage.

In the first presently preferred embodiment, the present invention accordingly provides for a toothbrush, comprising a handle at a proximal end of the toothbrush, a double sided brushing head portion at a distal end of the toothbrush connected to the handle, a first plurality of brushing bristles extending substantially perpendicularly from a first side of the head portion, and a second plurality of brushing bristles extending substantially perpendicularly from a second opposing side of the head portion and extending in a direction opposing the first plurality of bristles. In a presently preferred embodiment, the toothbrush is typically formed of durable plastic, and the second plurality of brushing bristles extends in a direction approximately 180° away from the first plurality of bristles.

In a second presently preferred embodiment, the double sided brushing head portion comprises a housing defining a hollow interior chamber with a distal opening, and the brushing head includes at least one retractable brushing bristle assembly movable between an extended position and a retracted position, with a first group of flexible bristles extending substantially perpendicularly from the first side of the head portion when the brushing bristle assembly is in an extended position.

In a presently preferred aspect of the second embodiment, the brushing head includes first and second brushing bristle assemblies mounted in the double sided brushing head portion. The first brushing bristle assembly includes a first plurality of flexible brushing bristles extending substantially perpendicularly from the first side of the head portion, with the first plurality of flexible brushing bristles being attached to a first sliding plate mounted within the double sided brushing head portion for sliding movement therein through the distal opening of the housing. Similarly, the second brushing bristle assembly includes a second plurality of flexible brushing bristles extending substantially perpendicularly from the second side of the head portion and extending in a direction opposing the first plurality of brushing bristles, with the second plurality of flexible brushing bristles being attached to a second sliding plate mounted within the double sided brushing head portion for sliding movement therein through the distal opening of the housing.

In another presently preferred aspect, the housing of the double sided brushing head portion defines a first slot, and the first sliding plate comprises a slide control button at a proximal end of the first sliding plate, the slide control button extending through the first slot, allowing the first sliding plate to be manually retracted within and extended from the hollow interior chamber of the housing of the brushing head portion, and allowing the first plurality of flexible brushing bristles to be retracted into the interior hollow chamber of the housing of the brushing head portion. Similarly, the housing of the double sided brushing head portion defines a second slot, and the second sliding plate comprises a slide control button at a proximal end of the second sliding plate, the slide control button extending through the second slot, allowing the second sliding plate to be manually retracted within and extended from the hollow interior chamber of the housing of the brushing head portion, and allowing the second plurality of flexible brushing bristles to be retracted into the interior hollow chamber of the housing of the brushing head portion.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
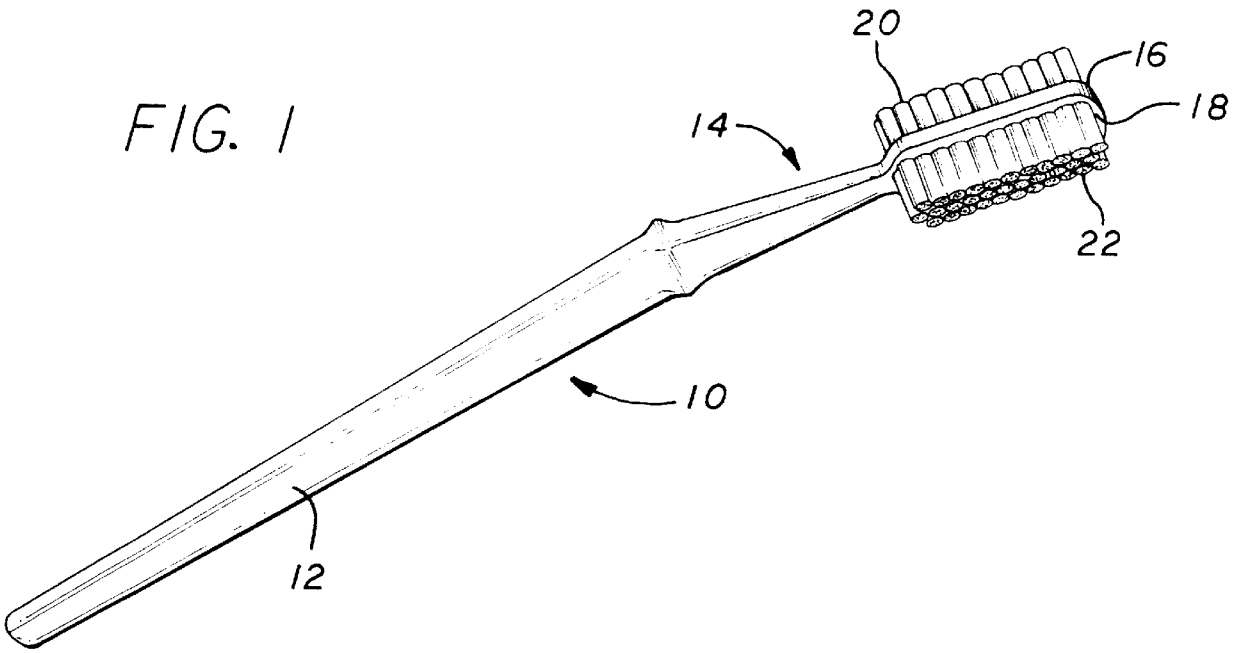
FIG. 1 is a perspective view of a first embodiment of the two-in-one toothbrush of the invention.

As is illustrated in the drawings, which are provided by way of example for purposes of illustration, in a first presently preferred embodiment, the invention provides for a dual brushing head design allowing the toothbrush to clean both the upper and lower teeth simultaneously. In another embodiment the toothbrush of the invention can additionally allow for the opposing sets of brushing bristles to be separately and independently extended for use, or retracted for clean, hygienic storage.

Figure 2:
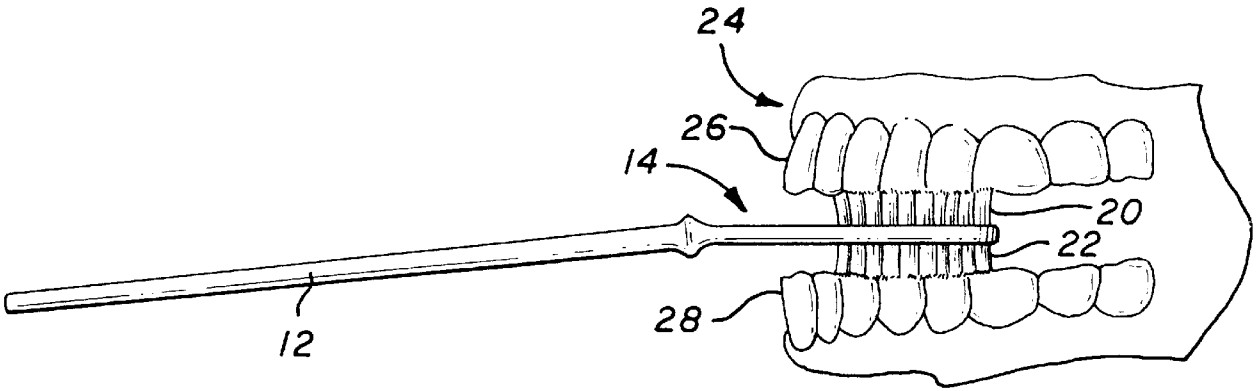
FIG. 2 is a side view of the two-in-one toothbrush of FIG. 1 illustrating use of the toothbrush for cleaning upper and lower teeth at the same time.

Referring to FIGS. 1 and 2, in a first embodiment the invention provides for a two-in-one toothbrush 10 having a handle 12 at a proximal end of the toothbrush, and a double sided brushing head portion 14 at the distal end of the toothbrush connected to the handle. While the toothbrush handle and brushing head portion are typically formed of durable plastic, other similar materials such as wood or metal may also be suitable.

The double sided brushing head preferably has a first side 16 and an opposing second side 18, with a first group of bristles 20 extending substantially perpendicularly from the first side of the head portion, and a second group of bristles 22 extending substantially perpendicularly from the second side of the head portion and extending direction opposing the first plurality of bristles, and preferably extending in a direction approximately 180° away from the first group of bristles. Referring to FIG. 2, the bristles of the first and second groups of bristles are typically slightly shorter than bristles of a conventional tooth brush having bristles on one side of the brushing head, to allow the brushing head to fit comfortably inside a user's mouth 24 between the upper teeth 26 and the lower teeth 28.

Figure 3:
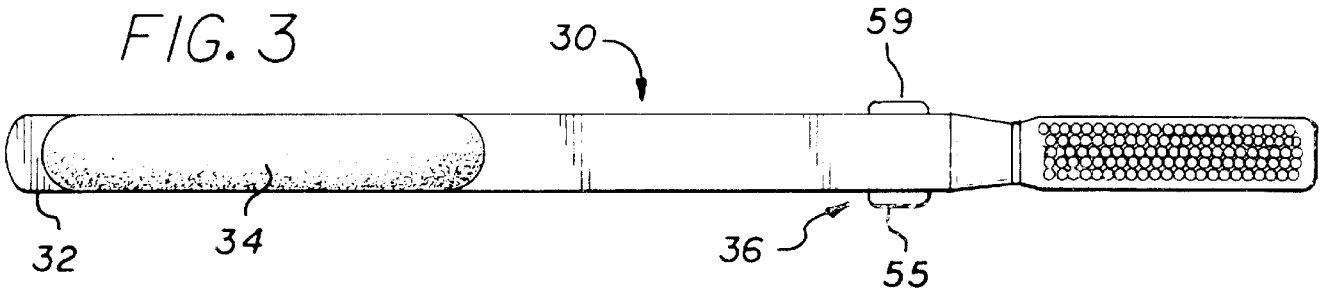
FIG. 3 is a top plan view of a second embodiment of the two-in-one toothbrush of the invention.
Figure 4:
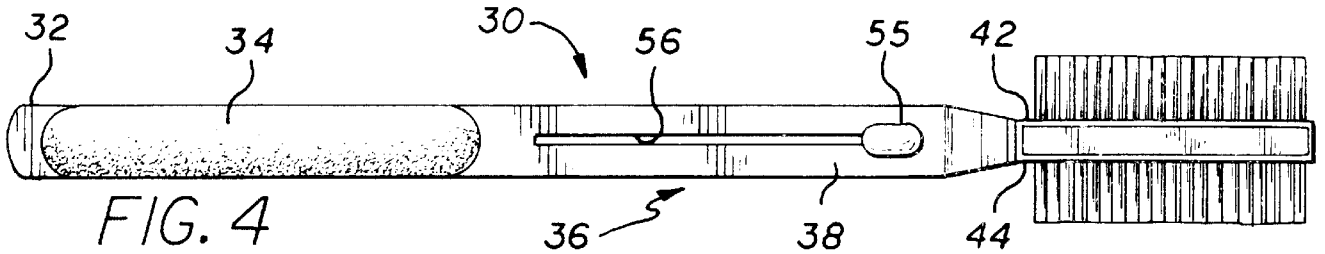
FIG. 4 is a side elevational view of the two-in-one toothbrush of FIG. 3.
Figure 5:
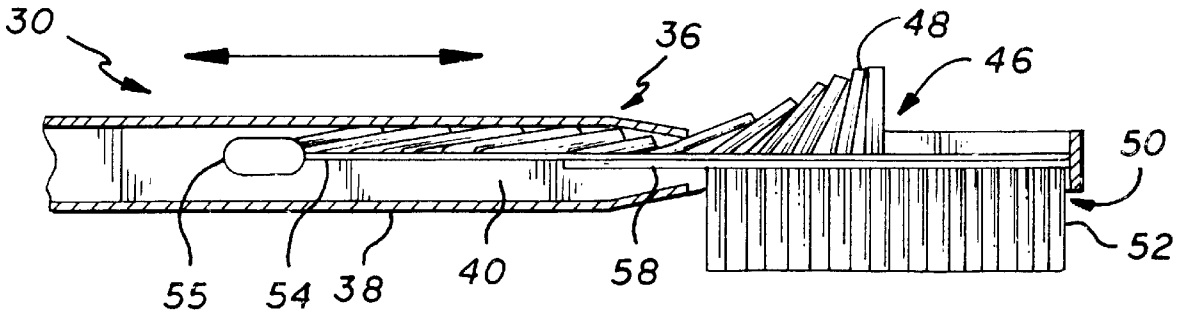
FIG. 5 is a partial sectional view of the two-in-one toothbrush of FIG. 4 illustrating retraction of one of the brushing bristle assemblies within the housing of the brushing head portion of the two-in-one toothbrush.

Referring to FIGS. 3, 4 and 5, in a second presently preferred embodiment, the invention provides for a toothbrush 30, having a handle 32 at a proximal end of the toothbrush. In a presently preferred aspect, rubber grips 34 are also preferably provided on the proximal end of the toothbrush handle. A brushing head portion 36 at the distal end of the toothbrush is connected to the handle, and the handle and brushing head portion are both typically formed of durable plastic, although other materials such as wood or metal may also be suitable. In this embodiment, the brushing head portion includes a housing 38 defining a hollow interior chamber 40, and having a first side 42 and an opposing second side 44. In a presently preferred embodiment, the brushing head includes at least one retractable brushing bristle assembly movable between an extended position and a retracted position, with a first group of flexible bristles extending substantially perpendicularly from the first side of the head portion when the brushing bristle assembly is in an extended position, as illustrated in FIGS. 3 and 4.

In a presently preferred embodiment, the brushing head includes a first brushing bristle assembly 46 with a first group of flexible bristles 48 that extends substantially perpendicularly from the first side of the head portion, and a second brushing bristle assembly 50 with a second group of flexible bristles 52 that extends substantially perpendicularly from the second side of the head portion and in a direction opposing the first plurality of bristles, and preferably approximately 180° away from the first group of bristles. The first group of flexible bristles are attached to a first sliding plate 54 mounted within the double sided brushing head portion for sliding movement therein by a slide control mechanism. The first sliding plate advantageously includes a slide control button 55 at the proximal end of the first sliding plate and extending through a slot 56 in the double sided brushing head portion, allowing the first sliding plate and first group of brushing bristles to be manually retracted within and extended from the hollow interior chamber of the housing of the brushing head portion. Similarly, the second group of flexible bristles are attached to a second sliding plate 58 mounted within the double sided brushing head portion for sliding movement therein by a slide control mechanism. The second sliding plate advantageously includes a slide control button 59 at the proximal end of the second sliding plate and extending through a similar slot (not shown) in the double sided brushing head portion, allowing the second sliding plate and the second group of brushing bristles to be manually retracted within and extended from the hollow interior chamber of the housing of the brushing head portion.

It should therefore readily be apparent that the slide control mechanism of the two in one toothbrush of the invention allows the user to retract the first and second groups of brushing bristles for storage, to extend both sets of brushing bristles for brushing between the occlusive sides of the upper and lower teeth, or to have one set of brushing bristles extended while the other set of brushing bristles is retracted, such as for brushing the lingual and gingival sides of the teeth. The bristles of the first and second groups of bristles are typically slightly shorter than bristles of a conventional tooth brush having bristles on one side of the brushing head, to allow the brushing head to fit comfortably inside a user's mouth between the upper teeth and the lower teeth. The two-in-one toothbrush may optionally be manufactured to include a variety of bristle types and configurations, such as soft, medium, hard, and the like, and the brush can be made in a variety of colors.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A toothbrush, comprising:

a handle at a proximal end of the toothbrush;

a double sided brushing head portion at a distal end of the toothbrush connected to the handle, said double sided brushing head portion having a first side and an opposing second side, and said double sided brushing head portion comprising a housing defining a hollow interior chamber with a distal opening;

a first plurality of brushing bristles extending substantially perpendicularly from the first side of the head portion; and a second plurality of brushing bristles extending substantially perpendicularly from the second side of the head portion and extending in a direction opposing the first plurality of brushing bristles.

2. The toothbrush of claim 1, wherein said handle and said brushing head are formed of durable plastic.

3. The toothbrush of claim 1, wherein said second plurality of brushing bristles extends approximately 180° away from the first plurality of brushing bristles.

4. The toothbrush of claim 1, wherein said brushing head comprises a first brushing bristle assembly mounted in said double sided brushing head portion, said first brushing bristle assembly mounting said first plurality of flexible brushing bristles so that said brushing bristles extend substantially perpendicularly from the first side of the head portion.

5. The toothbrush of claim 4, wherein said first brushing bristle assembly comprises a first sliding plate mounted within the double sided brushing head portion for sliding movement therein through said distal opening of said housing, said first plurality of flexible brushing bristles being attached to said first sliding plate.

6. The toothbrush of claim 5, wherein said housing of said double sided brushing head portion defines a first slot, and said first sliding plate comprises a slide control button at a proximal end of the first sliding plate, said slide control button extending through said first slot, allowing the first sliding plate to be manually retracted within and extended from the hollow interior chamber of the housing of the brushing head portion, and allowing the first plurality of flexible brushing bristles to be retracted into the interior hollow chamber of the housing of the brushing head portion.

7. The toothbrush of claim 4, wherein said brushing head further comprises a second brushing bristle assembly mounted in said double sided brushing head portion, said second brushing bristle assembly mounting said second plurality of flexible brushing bristles so as to extend substantially perpendicularly from the second side of the head portion and in a direction opposing the first plurality of brushing bristles.

8. The toothbrush of claim 7, wherein said second brushing bristle assembly comprises a second sliding plate mounted within the double sided brushing head portion for sliding movement therein through said distal opening of said housing, said second plurality of flexible brushing bristles being attached to said second sliding plate.

9. The toothbrush of claim 8, wherein said housing of said double sided brushing head portion defines a second slot, and said second sliding plate comprises a slide control button at a proximal end of the second sliding plate, said slide control button extending through said second slot, allowing the second sliding plate to be manually retracted within and extended from the hollow interior chamber of the housing of the brushing head portion, and allowing the second plurality of flexible brushing bristles to be retracted into the interior hollow chamber of the housing of the brushing head portion.

10. A toothbrush, comprising:

a handle at a proximal end of the toothbrush;

a double sided brushing head portion at a distal end of the toothbrush connected to the handle having a housing defining a hollow interior chamber with a distal opening, said double sided brushing head portion having a first side and an opposing second side;

a first brushing bristle assembly mounted in said double sided brushing head portion, said first brushing bristle assembly having a first plurality of flexible brushing bristles extending from the first side of the head portion, said first plurality of flexible brushing bristles being attached to a first sliding plate mounted within the double sided brushing head portion for sliding movement therein through said distal opening of said housing; and a second brushing bristle assembly mounted in said double sided brushing head portion, said second brushing bristle assembly having a second plurality of flexible brushing bristles extending from the second side of the head portion and extending in a direction opposing the first plurality of brushing bristles, said second plurality of flexible brushing bristles being attached to a second sliding plate mounted within the double sided brushing head portion for sliding movement therein through said distal opening of said housing.

11. The toothbrush of claim 10, wherein said handle includes rubber grips.

12. The toothbrush of claim 10, wherein said handle and said brushing head are formed of durable plastic.

13. The toothbrush of claim 10, wherein said housing of said double sided brushing head portion defines a first slot, and said first sliding plate comprises a slide control button at a proximal end of the first sliding plate, said slide control button extending through said first slot, allowing the first sliding plate and said first plurality of brushing bristles to be manually retracted within and extended from the hollow interior chamber of the housing of the brushing head portion.

14. The toothbrush of claim 10, wherein said wherein said housing of said double sided brushing head portion defines a second slot, and said second sliding plate comprises a slide control button at a proximal end of the second sliding plate, said slide control button extending through said second slot, allowing the second sliding plate and said second plurality of brushing bristles to be manually retracted within and extended from the hollow interior chamber of the housing of the brushing head portion.

15. The toothbrush of claim 10, wherein said first and second pluralities of brushing bristles extend substantially perpendicular to said brushing head portion, and said second plurality of brushing bristles extends approximately 180° away from the first plurality of brushing bristles when said first and second brushing bristles assemblies are extended.

* * * * *